US007714563B2

(12) United States Patent
Marinca

(10) Patent No.: US 7,714,563 B2
(45) Date of Patent: May 11, 2010

(54) LOW NOISE VOLTAGE REFERENCE CIRCUIT

(75) Inventor: Stefan Marinca, Limerick (IE)

(73) Assignee: Analog Devices, Inc., Norwood, MA (US)

( * ) Notice: Subject to any disclaimer, the term of this patent is extended or adjusted under 35 U.S.C. 154(b) by 367 days.

(21) Appl. No.: 11/717,516

(22) Filed: Mar. 13, 2007

(65) Prior Publication Data

US 2008/0224759 A1 Sep. 18, 2008

(51) Int. Cl.
*G05F 3/30* (2006.01)

(52) U.S. Cl. ..... 323/316; 323/313

(58) Field of Classification Search ..... 323/316, 323/313, 314, 317, 315; 327/539
See application file for complete search history.

(56) References Cited

U.S. PATENT DOCUMENTS 4,059,793 A * 11/1977 Ahmed ..... 323/313
4,399,398 A 8/1983 Wittlinger
4,475,103 A 10/1984 Brokaw et al.
4,603,291 A 7/1986 Nelson
4,714,872 A * 12/1987 Traa ..... 323/314
4,800,339 A 1/1989 Tanimoto et al.
4,808,908 A 2/1989 Lewis et al.
4,939,442 A 7/1990 Carvajal et al.
5,053,640 A 10/1991 Yum
5,119,015 A 6/1992 Watanabe
5,229,711 A 7/1993 Inoue
5,325,045 A 6/1994 Sundby
5,352,973 A 10/1994 Audy
5,371,032 A 12/1994 Nishihara
5,424,628 A 6/1995 Nguyen
5,512,817 A 4/1996 Nagaraj
5,563,504 A * 10/1996 Gilbert et al. ..... 323/316
5,646,518 A 7/1997 Lakshmikumar et al.
5,821,807 A 10/1998 Brooks
5,828,329 A 10/1998 Burns
5,933,045 A 8/1999 Audy et al.
5,952,873 A 9/1999 Rincon-Mora
5,982,201 A 11/1999 Brokaw et al.
6,002,293 A 12/1999 Brokaw
6,075,354 A 6/2000 Smith et al.
6,157,245 A 12/2000 Rincon-Mora
6,218,822 B1 4/2001 MacQuigg
6,225,796 B1 5/2001 Nguyen
6,255,807 B1 7/2001 Doorenbos et al.

(Continued)

FOREIGN PATENT DOCUMENTS

EP 0510530 10/1992

(Continued)

OTHER PUBLICATIONS

PCT/EP2008/058685 International Search Report and written opinion, Oct. 1, 2008.

(Continued)

*Primary Examiner*—Harry Behm
(74) *Attorney, Agent, or Firm*—Kenyon & Kenyon LLP

(57) ABSTRACT

A low noise voltage reference circuit is described. The reference circuit utilizes a bandgap reference component and may include at least one of a current shunt or filter to reduce high and low noise contributions to the output. Further modifications may include a curvature correction component.

32 Claims, 1 Drawing Sheet

U.S. PATENT DOCUMENTS 6,329,804 B1 12/2001 Mercer
6,329,868 B1 12/2001 Furman
6,356,161 B1 3/2002 Nolan et al.
6,362,612 B1 3/2002 Harris
6,373,330 B1 4/2002 Holloway
6,426,669 B1 7/2002 Friedman et al.
6,462,625 B2 10/2002 Kim
6,483,372 B1 11/2002 Bowers
6,489,787 B1 12/2002 McFadden
6,489,835 B1 12/2002 Yu et al.
6,501,256 B1 12/2002 Jaussi et al.
6,529,066 B1 3/2003 Guenot et al.
6,531,857 B2 3/2003 Ju
6,549,072 B1 4/2003 Vernon
6,590,372 B1 7/2003 Wiles, Jr.
6,614,209 B1 9/2003 Gregoire, Jr.
6,642,699 B1 11/2003 Gregoire, Jr.
6,661,713 B1 12/2003 Kuo
6,664,847 B1 12/2003 Ye
6,690,228 B1 2/2004 Chen et al.
6,791,307 B2 9/2004 Harrison
6,798,286 B2 9/2004 Dauphinee et al.
6,801,095 B2 10/2004 Renninger, II
6,828,847 B1 12/2004 Marinca
6,836,160 B2 12/2004 Li
6,853,238 B1 2/2005 Dempsey et al.
6,885,178 B2 4/2005 Marinca
6,891,358 B2 5/2005 Marinca
6,894,544 B2 5/2005 Gubbins
6,919,753 B2 7/2005 Wang et al.
6,930,538 B2 8/2005 Chatal
6,958,643 B2 10/2005 Rosenthal
6,987,416 B2 1/2006 Ker et al.
6,992,533 B2 1/2006 Hollinger et al.
7,012,416 B2 3/2006 Marinca
7,057,444 B2 6/2006 Illegems
7,068,100 B2 6/2006 Dauphinee et al.
7,088,085 B2 8/2006 Marinca
7,091,761 B2 8/2006 Stark
7,112,948 B2 9/2006 Daly et al.
7,170,336 B2 1/2007 Hsu
7,173,407 B2 2/2007 Marinca
7,193,454 B1 3/2007 Marinca
7,199,646 B1 4/2007 Zupcau et al.
7,211,993 B2 5/2007 Marinca
7,224,210 B2 5/2007 Garlapati et al.
7,236,047 B2 6/2007 Tachibana et al.
7,248,098 B1 7/2007 Teo
7,260,377 B2 8/2007 Burns et al.
7,301,321 B1 11/2007 Uang et al.
7,342,390 B2 * 3/2008 Tachibana et al. ..... 323/316
7,372,244 B2 5/2008 Marinca
7,411,380 B2 8/2008 Chang et al.
7,472,030 B2 12/2008 Scheuerlein
7,482,798 B2 1/2009 Han
2003/0234638 A1 12/2003 Eshraghi et al.
2005/0073290 A1 4/2005 Marinca et al.
2005/0194957 A1 9/2005 Brokaw
2005/0237045 A1 10/2005 Lee et al.
2006/0001413 A1 * 1/2006 Marinca ..... 323/315
2006/0017457 A1 1/2006 Pan et al.
2006/0038608 A1 2/2006 Ozawa
2007/0176591 A1 8/2007 Kimura
2008/0018319 A1 1/2008 Chang et al.
2008/0074172 A1 3/2008 Marinca
2008/0224759 A1 9/2008 Marinca
2008/0265860 A1 10/2008 Dempsey et al.

FOREIGN PATENT DOCUMENTS

EP 1359490 A2 11/2003
EP 1359490 A3 11/2003
JP 4-167010 6/1992
KR 0115143 12/2007
WO WO 2004/007719 2/2004

OTHER PUBLICATIONS

PCT/EP2008/051161 International Search Report and written opinion, May 16, 2008.
Chen, Wai-Kai, "The circuits and filters handbook", 2nd ed, CRC Press, 2003.
Cressler, John D., "Silicon Heterostructure Handbook", CRC Press-Taylor & Francis Group, 2006; 4.4-427-438.
Banba et al, "A CMOS bandgap reference circuit with Sub-1-V operation", IEEE JSSC vol. 34, No. 5, May 1999, pp. 670-674.
Brokaw, A. Paul, "A simple three-terminal IC bandgap reference", IEEE Journal of Solid-State Circuits, vol. SC-9, No. 6, Dec. 1974, pp. 388-393.
Jones, D.A., and Martin, K., "Analog Integrated Circuit Design", John Wiley & Sons, USA, 1997 (ISBN 0-47L-L4448-7, pp. 353-363).
Malcovati et al, "Curvature-compensated BiCMOS bandgap with 1-V supply voltage", IEEE JSSC, vol. 36, No. 7, Jul. 2001.
Sudha et al, "A low noise sub-bandgap voltage reference", IEEE, Proceedings of the 40th Midwest Symposium on Circuits and Systems, 1997. vol. 1, Aug. 3-6, 1997, pp. 193-196.
Widlar, Robert J., "New developments in IC voltage regulators", IEEE Journal of Solid-State Circuits, vol. SC-6, No. 1, Feb. 1971, pp. 2-7.
Jianping, Zeng, et al, "CMOS Digital Integrated temperature Sensor", IEEE, Aug. 2005, pp. 310-313.
Gray, Paul R., et al, *Analysis and Design of Analog Integrated Circuits*, Chapter 4, 4th ed., John Wiley & Sons, Inc., 2001, pp. 253-327.
PCT/EP2005/052737 International Search Report, Sep. 23, 2005.
PCT/EP2008/067402 International Search Report, Mar. 20, 2009.
PCT/EP2008/067403, International Search Report and Written Opinion, Apr. 27, 2009.
Pease, R.A., "The design of band-gap reference circuits: trials and tribulations", IEEE 1990 Bipolar circuits and Technology Meeting 9.3, Sep. 17, 1990, pp. 214-218.

* cited by examiner

LOW NOISE VOLTAGE REFERENCE CIRCUIT

TECHNICAL FIELD

The present invention relates to bandgap based voltage reference circuits, and in particular to voltage references having very low noise.

BACKGROUND

Reference voltages are widely used in electronic circuits especially in analog circuits where electrical signals have to be compared to a standard signal, stable with environmental conditions. The most adverse environmental factor for circuits on a chip is temperature. A reference voltage based on the bandgap principle consists of the summation of two voltages having opposite variations with temperature. The first voltage corresponds to a forward biased p-n junction having a Complimentary to Absolute Temperature (CTAT) variation with a drop of about 2.2 mV/° C. The PTAT voltage is generated by amplifying the base-emitter voltage difference of two bipolar transistors operating at different collector current density. A first order temperature insensitive voltage is generated by adding a CTAT voltage to a Proportional to Absolute Temperature (PTAT) voltage such that the two slopes compensate each other. If the PTAT and CTAT are well balanced, all that remains is a second order curvature effect, which may be compensated for as required by inclusion of additional circuitry.

While such circuits offer temperature insensitive reference voltages they suffer somewhat in that they are affected by voltage noise on the resultant reference voltage. As it is known to those skilled in the art, the voltage noise on a reference voltage has two components. A first component called low band noise, or 1/f noise or sometimes referred to as flicker noise typically has a contribution in the range from 0.1 Hz to 10 Hz. A second component referred to as high band noise, or white noise typically has a contribution over 10 Hz.

A major source of the low band noise in bandgap voltage references based on bipolar transistors, which is not easy to compensate, is generated by the bipolar base current and in order to reduce this noise the base current has to be reduced. One solution to reduce the base current and the associated 1/f noise is to use bipolar transistors with very high gain, which is the ratio of collector current to base current, usually called "beta" factor. From a cost or efficiency point of view it is always preferable to design a circuit using normal processes where "beta" factor is typical of the order of one hundred. Such beta factors are not typically sufficient to compensate for the low band noise.

The high band noise is generated by collector current such that the higher the collector current, the lower the high band noise. In order to reduce high band noise collector (and base) current have to be increased. As a result the operation conditions required to minimize low band noise and high band noise are opposite to one another. This makes it difficult to achieve circuitry which can minimize both these noise contributions simultaneously.

There are therefore a number of problems associated with generating voltage references with low noise contributions.

SUMMARY

These and other problems are addressed in accordance with the teaching of the invention by a circuit that provides a bandgap reference output with reduced noise contributions.

Using the teaching of the present invention it is possible to minimize one or both of low band and high band noise effects on the reference voltage output. Such teaching is enabled by providing a voltage reference circuit that includes an amplifier coupled at its input to a high impedance input, the high impedance input being provided by a first set of bipolar transistors that collectively contribute to the formation of a bandgap reference and also for a pre-amplifier stage for the amplifier.

The present invention provides an improved voltage reference having very low 1/f noise and/or very low high band noise. In order to reduce 1/f voltage noise the two bipolar transistors acting as a preamplifier are shunted by two similar transistors with larger emitter area such that the collector and base currents of the two bipolar transistors from the preamplifier are accordingly reduced. In order to reduce high band noise from the voltage reference a capacitor is connected from the high impedance common collector node of the preamplifier to ground.

These and other features of the invention will now be described with reference to exemplary embodiments which are useful in an understanding of the teaching of the invention but are not intended to limit the invention in any way except as may be deemed necessary in the light of the appended claims.

DETAILED DESCRIPTION

Figure 1:
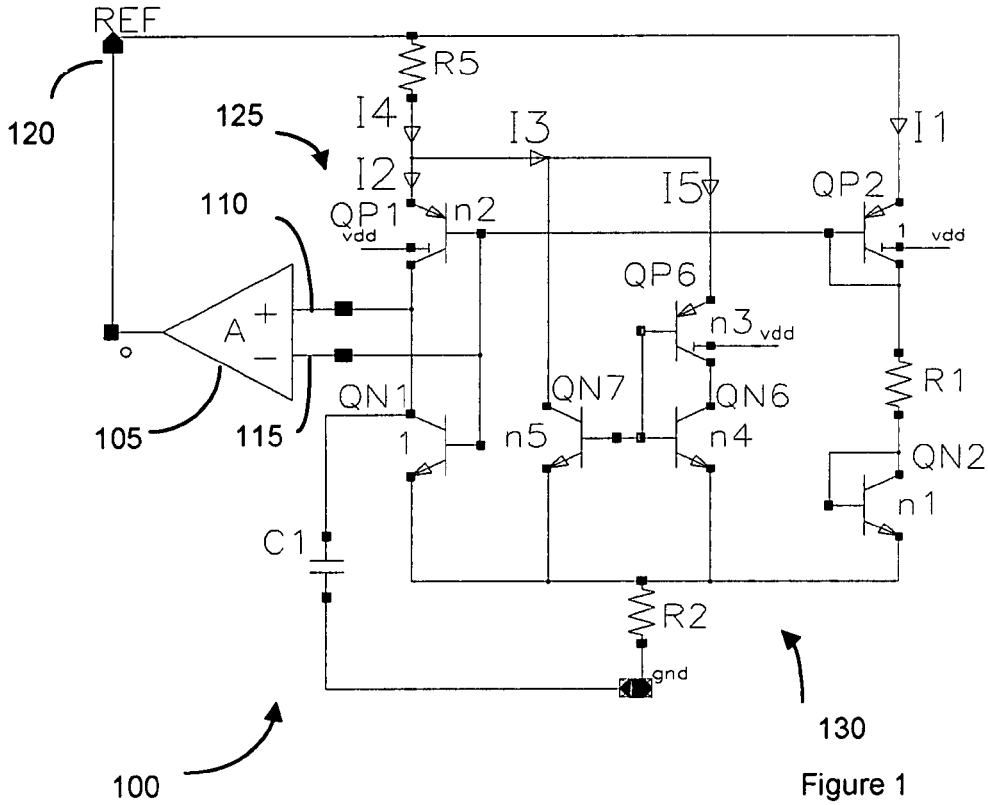
FIG. 1 is an embodiment of the bandgap voltage reference in accordance with the teaching of the present invention.

As shown in FIG. 1 a bandgap voltage reference circuit 100 in accordance with the teaching of the invention includes a first amplifier 105 having first and second inputs 110, 115 and providing at its output 120 a voltage reference. Coupled to the first and second inputs are a first pair of transistors 125 and a second pair of transistors 130 respectively.

The first pair of transistors 125 includes two pnp bipolar transistors; a first bipolar transistor QP1 and second bipolar transistor QP2 of the circuit. The bases of each of the first and second transistor are coupled together, the first transistor being additionally coupled to the amplifier input via its collector node and to the amplifier output 120 via a resistor R5. The second transistor is provided in a diode configuration with its base and emitter commonly coupled.

The second pair of transistors 130 which is coupled to the second input 115 includes two npn transistors; a third transistor QN1 and a fourth transistor QN2 of the circuit and a load resistor R1. The fourth transistor QN2 is also provided in a diode configuration, and the load resistor R1 couples the commonly coupled base-collector of QN2 to the commonly coupled base-collector of QP2. The commonly coupled emitters of QN1 and QN2 are coupled via a resistor R2 to ground.

The base of QN1 is coupled to the commonly coupled bases of QP1 and QP2 and to the second input of the amplifier thereby coupling the first and second pairs of transistors and providing a base current for all three transistors, the amplifier, in use, keeping the base and collector of the first transistor at the same potential.

The emitter areas of QN2 and QP1 are scaled to be "n" times larger than that of QN1 and QP2. As a result of this scaling, two base-emitter voltage differences are developed across R1 and R5, respectively. These two voltages are of the form of proportional to absolute temperature (PTAT) voltages. The currents from two branches (R5, QP1, QN1 and QP2, R1, QN2) are PTAT currents and they are combined to generate a PTAT voltage across R2. A first order temperature insensitive voltage is generated when the temperature slope of this voltage is compensated by the temperature slope of base-emitter voltages of QN1 plus QP2.

It will be understood that this circuit has an inherent base current compensation as the base current of QP1 is used as base current of QN1 when they are balanced, such that the error due to the base current is minimized. Secondly, QP1 and QN1 act as a preamplifier such that the operational requirements for the amplifier A are relaxed. Thirdly, as the amplifier is connected after the pre-amplifier stage, its offset voltage and noise have little impact on the reference voltage. It will be noted that the non-inverting input to the amplifier is a high impedance input. The main role of resistor R5 in FIG. 1 is to reduce the noise contribution of QN1 and QP1 on reference voltage. The circuit of FIG. 1 can be used to generate a low noise voltage reference especially for high precision digital to analog and analog to digital converters.

It will be understood that the components described heretofore as forming the bandgap cell, while providing a low noise output still have low band and high band noise contributions at the voltage reference output. The effects of these can be minimized independently of one another by utilization of additional circuit components according to the teaching of the invention.

Addressing the high band noise initially, the teaching of the invention provides for a capacitor C1 to be coupled to the commonly coupled collectors of QP1 and QN1. As was mentioned above these two transistors effectively form a pre-amplifier to the amplifier A, and the capacitor C1 is provided at the node between the pre-amplifier and the amplifier input. Such a capacitor provided at the input to the amplifier, may be provided as an external capacitor and serves to filter the high band noise. The cut-off frequency due to C1 and the output impedance of QP1 and QN1 is:

$$f_{-3db} = \frac{r_{01} + r_{02}}{2 * \pi * r_{01} * r_{02} * C_1} \tag{1}$$

Here $r_{01}$ and $r_{02}$ are the output resistors of QP1 and QN1. It will be understood by those skilled in the art that that lower limits for wide band noise are typically of the order of 10 Hz. At such levels, and using typical values of resistors for $r_{01}$ and $r_{02}$ as providing a product of the order of 2 MΩ, it can be estimated that to provide the necessary cut-off frequency that a capacitor of the order of 8 nF would be required. To implement such a capacitor in silicon may require the provision of that capacitor as an off-chip element. However, if one is tolerable to cut-off frequencies above about 800 Hz, then use of capacitors of the order of the order of 10-100 pF may be satisfactory. Such capacitors can be provided on-chip using a silicon substrate. By having a high impedance input, the non-inverting input, to the amplifier it is possible to provide the capacitor at this input. This is advantageous in that a provision of a capacitor at the output could introduce stability issues with regard to the performance of the amplifier. These issues are not encountered with the capacitor at the input, as provided by the teaching of the invention.

While the provision of the capacitor serves to address the high band noise, the circuit may also be modified to address the 1/f or low band noise. In order to reduce 1/f voltage noise the two bipolar transistors QP1, QN1 acting as a preamplifier in FIG. 1 are shunted by two similar transistors with larger emitter area such that the collector and base currents of the two bipolar transistors from the preamplifier are accordingly reduced.

The shunt circuitry according to this illustrative embodiment includes two npn transistors QN7, QN6 and one pnp transistor QP6. The emitter areas of the bipolar transistors desirably chosen such that QN1, unity emitter area; QN2, n1 times unity emitter area; QP2 unity emitter area; QP1, n2 times unity emitter area; QP6, n3 times unity emitter area; QN6, n4 times unity emitter area; QN7, n5 times unity emitter area. The role of QP6, QN6 and QN7 is to reduce the collector and base current of QP1 and QN1 and by consequence to reduce the low band noise.

The current through R1 which is also the emitter current of QP2 and QN2 comes from the base-emitter voltage difference of QN1 and QN2. The current through R5 is the sum of emitter current of QP1, emitter current of QP6 and collector current of QN7. We assume that for all bipolar transistors the base currents can be neglected compared to the corresponding emitter and collector current.

The base-emitter voltage, Vbe, of each bipolar transistor is given [2] as:

$$V_{be} = \frac{KT}{q}\ln\left(\frac{Ic}{Is}\right) \tag{2}$$

Here:

K is boltzman constant;

T is actual absolute temperature [K];

q is electronic charge;

Ic is collector current;

Is saturation current, proportional to the emitter area.

The base-emitter voltage difference from QN1 to QN2, due to the different collector currents and different emitter areas is reflected across R1:

$$I_1 * R_1 = \frac{KT}{q}\ln\left(\frac{I_2}{I_1}n_1\right) \tag{3}$$

Similarly the base-emitter voltage difference from QP1 to QP2 is reflected across R5:

$$I_4 * R_5 = \frac{KT}{q}\ln\left(\frac{I_1}{I_2}n_2\right) \tag{4}$$

From (3) and (4) we get:

$$I_1 * R_1 + I_4 * R_5 = \frac{KT}{q}\ln(n_1 * n_2) \tag{5}$$

From (5) we can see that the sum of voltage drop across R1 and R2 is constant for a specific temperature. If R1 and R2 are given then as one current increases the other is decreases.

For QP6 and QN6 with a combined larger area compared to QP1 and QN1 the current I4, is diverted away from the emitter and collector of QP1 and QN1. As a result the collector and base current of QP1, QN1 is reduced and the flicker noise due to these transistors is accordingly reduced.

The voltage difference from the emitter of QP1 to the emitter of QN1 is:

$$\frac{KT}{q}\ln\left(\frac{I_2}{n_2 * I_s}\right) + \frac{KT}{q}\ln\left(\frac{I_2}{I_s}\right) = \frac{KT}{q}\ln\left(\frac{I_5}{n_3 * I_s}\right) + \frac{KT}{q}\ln\left(\frac{I_5}{n_4 * I_s}\right) \quad (6)$$

From (6) we get:

$$I_5 = \sqrt{\frac{n_3 * n_4}{n_2}} * I_2 \quad (7)$$

The collector current of QN7, Ic(QN7), is:

$$I_c(QN7) = I_5 * \frac{n_5}{n_4} \quad (8)$$

The currents $I_3$ and $I_4$ are:

$$I_3 = I_5 + I_c(QN7) = I_2 * \sqrt{\frac{n_3 * n_4}{n_2}}\left(1 + \frac{n_5}{n_4}\right) \quad (9)$$

$$I_4 = I_3 + I_2 = I_2\left[1 + \sqrt{\frac{n_3 * n_4}{n_2}}\left(1 + \frac{n_5}{n_4}\right)\right] \quad (10)$$

In the circuit of FIG. 1 there are four dominant flicker noise sources, QP1, QN1, QP2, and QN2. For a given supply current as two currents, $I_1$ and $I_2$, interact according to (5) a preferred tradeoff is to reduce the current $I_2$, by properly adjusting the resistor ratio $R_1/R_5$ and the area ratios, $n_1$ to $n_5$, until these four noise sources are balanced to generate a minimum flicker noise.

By incorporating a filter and a current shunt into the bandgap voltage reference cell it is possible to reduce the low and high band noise. Illustrative, but it will be appreciated exemplary, values of improvement are that using a circuit in accordance with the teaching of the invention that it is possible it is possible generate three times less flicker noise and about five times less wide band noise than circuits without such filters or shunts.

While the capacitor C1 may be used independently of the shunt circuitry and similarly the shunt circuitry may be used independently of a provided capacitor, the use of both provides for a simultaneous reduction in the high and low band noise. Similarly the capacitor C1 may be provided in one or more components. Furthermore where the shunt circuitry is included, there is a large output impedance at the amplifier's non-inverting node as the currents through QP1 and QN1 are substantially reduced. As a result by combining the shunt circuitry with the capacitor a more efficient reduction in the high band noise is achieved than by using the capacitor in isolation.

Figure 2:
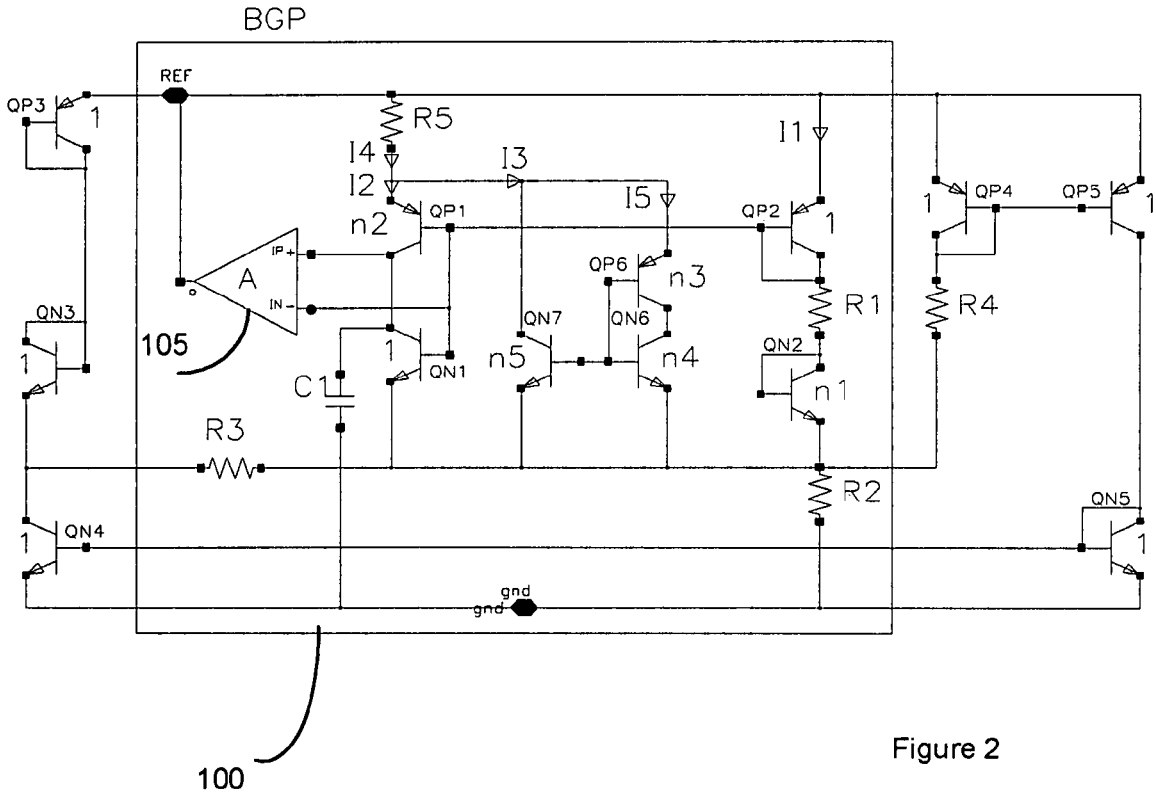
FIG. 2 is a modification of the circuit of FIG. 1 to include a curvature correction component, again according to the teaching of the invention.

While the circuit of FIG. 1 is advantageous in that it provides a first order temperature insensitive bandgap reference circuit with reduced noise contributions it is possible to modify that circuit to include a reduction in the second order curvature effects. An example of a suitable modification is shown in FIG. 2 where three pnp bipolar transistors, QP3, QP4, QP5; three npn bipolar transistors, QN3, QN4, QN5 and two resistors, R3 and R4 are included. The inclusion of these circuit components provides, in certain embodiments, for a compensation of the inherent TlogT voltage curvature that is present in the voltage reference generated from the bandgap cell. In order to do this it is necessary to provide a TlogT signal of opposite sign to the inherent TlogT signal generated. This arrangement provides for the generation of this TlogT signal by providing a complementary to absolute temperature current and using this current in combination with a third resistor, R3. The CTAT current, may be externally generated, or as shown in FIG. 2, may be provided by providing a transistor QP4 in series between the output of the amplifier and resistor R4 to generate and mirror the CTAT current via the bipolar transistor QP5. The CTAT current generated is then mirrored via a diode configured transistor QN5 to another npn transistor QN4 and the CTAT current reflected on the collector of QN4 is pulled from the reference node, Vref, via two bipolar transistors: QP3 having similar base/emitter voltages to QP2, and QN3 with similar base/emitter voltages to QN1. The resistor R3 is provided between the commonly coupled collector of QN4/emitter of QN3 and the emitter of QN1. As a result across R3 a voltage curvature of the form of TlogT is developed. By properly scaling the ratio of R3 to R2 the voltage curvature is reduced to zero.

This extra circuit has the role of compensating for the residual error known as "curvature" error and to shift the reference voltage to a desired value. The amplifier A is forcing the reference voltage at the node REF by keeping the base-collector voltage of QP1 and QN1 at substantially zero level. This combination of the two TlogT voltages of opposite signs provides a voltage reference at the output of the amplifier which is corrected for second order characteristics. The reference to the second order voltage reference is reflective of the fact that the curvature component is a second order effect.

Similarly, it will be understood that the present invention provides a bandgap voltage reference circuit that utilizes an amplifier with an inverting and non-inverting input and providing at its output a voltage reference. First and second pairs of transistors are provided, each pair being coupled to a defined input of the amplifier. By providing an NPN and PNP bipolar transistors coupling the bases of these two transistors together it is possible to connect the two pairs. This provides a plurality of advantages including the possibility of these transistors providing amplification functionality equivalent to a first stage of an amplifier. By providing a "second" amplifier it is possible to reduce the complexity of the architecture of the actual amplifier and also to reduce the errors introduced at the inputs of the amplifier. Furthermore the provision of a preamplifier or first stage of an amplifier provides a high impedance input to the amplifier which may be used in combination with a capacitor coupled between that input and ground so as to filter high band noise. By incorporating a shunt circuit which diverts some of the current from the feedback loop it is possible to reduce the collector emitter currents and hence the base currents of the transistors forming the bandgap cell, thereby reducing the 1/f noise that would otherwise inherently be present. The shunt circuitry serves to divert some of the emitter current of the first transistor; by lowering the emitter/collector currents it is possible to drive down the base current of the bipolar transistors, which as mentioned above is a primary source of the 1/f noise.

It will be understood that the present invention has been described with specific PNP and NPN configurations of bipolar transistors but that these descriptions are of exemplary embodiments of the invention and it is not intended that the application of the invention be limited to any such illustrated configuration. It will be understood that many modifications and variations in configurations may be considered or achieved in alternative implementations without departing from the spirit and scope of the present invention. Specific components, features and values have been used to describe the circuits in detail, but it is not intended that the invention be limited in any way except as may be deemed necessary in the light of the appended claims. It will be further understood that some of the components of the circuits hereinbefore described have been with reference to their conventional signals and the internal architecture and functional description of for example an amplifier has been omitted. Such functionality will be well known to the person skilled in the art and where additional detail is required may be found in any one of a number of standard text books.

Similarly the words comprises/comprising when used in the specification are used to specify the presence of stated features, integers, steps or components but do not preclude the presence or addition of one or more additional features, integers, steps, components or groups thereof.

The invention claimed is:

1. A bandgap reference circuit including an amplifier having an inverting and a non-inverting input and providing at its output a voltage reference, the circuit including:

a. a first pair of transistors, the first pair including a first and second transistor of the circuit, the first transistor being coupled to the non-inverting input of the amplifier, the bases of the first and second transistors being commonly coupled, the first transistor being additionally coupled to the amplifier output via a feedback resistor, the second transistor being provided in a diode configuration, b. a second pair of transistors, the second pair including a third and fourth transistor of the circuit, the third transistor being coupled to the inverting input of the amplifier, the emitters of the third and fourth transistors being coupled to ground via a reference resistor, the fourth transistor being provided in a diode configuration and being coupled via a coupling resistor to the second transistor, and wherein the base of the third transistor is coupled to the commonly coupled first and second transistors, the collector of the third transistor being coupled to the collector of the first transistor such that the first and third transistors form a preamplifier to the amplifier, and further wherein the emitter areas of the first and fourth transistors are scaled to be larger than that the emitter areas of the second and third transistors such that two base-emitter voltage differences, of the form of proportional to absolute temperature (PTAT) voltages, are developed across the coupling and feedback resistors respectively, the resultant PTAT currents generating a PTAT voltage across the reference resistor, this PTAT voltage in combination with the base emitter voltages of the combined second and third transistors being reflected at the output of the amplifier as a first order temperature insensitive voltage, and further wherein the circuit includes a filter provided between the non-inverting input and ground to minimize high band noise contributions to said temperature insensitive voltage, the circuit further including: a current shunt provided to shunt at least a portion of the feedback current away from the first transistor so as to effect a reduction in the collector and base currents of the first and third transistors thereby reducing low band noise contributions to said temperature insensitive voltage.

2. The circuit as claimed in claim 1 wherein the current shunt is configured to reduce the collector current of the first and third transistors and as a result to effect a reduction in the base currents of the first and third transistors.

3. The circuit as claimed in claim 2 wherein the current shunt includes two npn transistors and one pnp transistor, the pnp transistor forming a fifth transistor of the circuit, the two npn transistors forming sixth and seventh transistors of the circuit.

4. The circuit of claim 3 wherein the emitter areas of the transistors are chosen such that the second and third transistors have a first emitter area, n, the fourth transistor has a second emitter area n1, the first transistor has a third emitter area, n2, the fifth transistor has a fourth emitter area, n3, the sixth transistor has a fifth emitter area, n4 and the seventh transistor has a sixth emitter area, n5, the emitter areas being scaled such that n5>n4>n3>n2>n1>n.

5. The circuit of claim 1 wherein the filter includes a capacitor.

6. The circuit of claim 5 wherein the capacitor has a value less than 1000 pF.

7. The circuit of claim 6 wherein the capacitor has a value less than 200 pF.

8. The circuit of claim 6 wherein the capacitor has a value of about 100 pF.

9. The circuit of claim 1 further including a curvature correction component.

10. The circuit of claim 9 wherein the curvature correction component is configured to provide a correction voltage of the type TlogT of opposite sign to that of the first order voltage reference voltage output, the correction voltage being combined with the first order voltage reference to provide a curvature corrected voltage reference.

11. A bandgap reference circuit including an amplifier having an inverting and a non-inverting input and providing at its output a voltage reference, the circuit including:

a. a first pair of transistors of a first type the first pair including a first and second transistor of the circuit, the first transistor being coupled to the non-inverting input of the amplifier, the bases of the first and second transistors being commonly coupled, the first transistor being additionally coupled to the amplifier output via a feedback resistor, the second transistor being provided in a diode configuration, b. a second pair of transistors of a second type, the second pair including a third and fourth transistor of the circuit, the third transistor being coupled to the inverting input of the amplifier, the emitters of the third and fourth transistors being coupled to ground via a reference resistor, the fourth transistor being provided in a diode configuration and being coupled via a coupling resistor to the second transistor, and wherein the base of the third transistor is coupled to the commonly coupled first and second transistors, the collector of the third transistor being coupled to the collector of the first transistor such that the first and third transistors form a preamplifier to the amplifier, and further wherein the emitter areas of the first and fourth transistors are scaled to be larger than the emitter areas of the second and third transistors such that two base-emitter voltage differences, of the form of proportional to absolute temperature (PTAT) voltages, are developed across the coupling and feedback resistors respectively, the resultant PTAT currents generating a PTAT voltage across the reference resistor, this PTAT voltage in combination with the base emitter voltages of the combined second and third transistors being reflected at the output of the amplifier as a first order temperature-insensitive voltage, and further wherein the circuit includes a current shunt configured to shunt at least a portion of the feedback current away from the first transistor so as to effect a reduction in the collector and base currents of the first and third transistors thereby reducing low band noise contributions to said this temperature-insensitive voltage.

12. The circuit as claimed in claim 11 wherein the current shunt is configured to reduce the collector current of the first and third transistors and as a result to effect a reduction in the base currents of the first and third transistors.

13. The circuit as claimed in claim 12 wherein the current shunt includes two npn transistors and on pnp transistor, the pnp transistor forming a fifth transistor of the circuit, the two npn transistors forming sixth and seventh transistors of the circuit.

14. The circuit of claim 13 wherein the emitter areas of the transistors are chosen such that the second and third transistors have a first emitter area, n, the fourth transistor has a second emitter area n1, the first transistor has a third emitter area, n2, the fifth transistor has a fourth emitter area, n3, the sixth transistor has a fifth emitter area, n4 and the seventh transistor has a sixth emitter area, n5, the emitter areas being scaled such that n5>n4>n3>n2>n1>n.

15. The circuit of claim 11 further including a filter provided between the non-inverting input and ground to minimize high band noise contributions to said temperature insensitive voltage.

16. The circuit of claim 15 wherein the filter includes a capacitor.

17. The circuit claim 16 wherein the capacitor has a value less than 1000 pF.

18. The circuit of claim 16 wherein the capacitor has a value less than 200 pF.

19. The circuit of claim 18 wherein the capacitor has a value of about 100 pF.

20. The circuit of claim 11 further including a curvature correction component.

21. The circuit of claim 20 wherein the curvature correction component is configured to provide a correction voltage of the type TlogT of opposite sign to that of the first order voltage reference voltage output, the correction voltage being combined with the first order voltage reference to provide a curvature corrected voltage reference.

22. A bandgap reference circuit including an amplifier having an inverting and a non-inverting input and providing at its output a voltage reference, the circuit including:

a. a first pair of pnp transistors, the first pair including a first and second transistor of the circuit, the first transistor being coupled to the non-inverting input of the amplifier, the bases of the first and second transistors being commonly coupled, the first transistor being additionally coupled to the amplifier output via a feedback resistor, the second transistor being provided in a diode configuration, b. a second pair of npn transistors, the second pair including a third and fourth transistor of the circuit, the third transistor being coupled to the inverting input of the amplifier, the emitters of the third and fourth transistors being coupled to ground via a reference resistor, the fourth transistors being coupled to ground via a reference resistor, the fourth transistor being provided in a diode configuration and being coupled via a coupling resistor to the second transistor, and wherein the base of the third transistor is coupled to the commonly coupled first and second transistors, collector of the third transistor being coupled to the collector of the first transistor such that the first and third transistors form a preamplifier to the amplifier, and further wherein the emitter areas of the first and fourth transistors are scaled to be larger than that the emitter areas of the second and third transistors such that two base-emitter voltage differences, of the form of proportional to absolute temperature (PTAT) voltages, are developed across the coupling and feedback resistors respectively, the resultant PTAT currents generating a PTAT voltage across the reference resistor, this PTAT voltage in combination with the base emitter voltages of the combined second and third transistors being reflected at the output of the amplifier as a first order temperature insensitive voltage, and further wherein the circuit further includes: a filter provided between the non-inverting input and ground to minimize high band noise contributions to said temperature insensitive voltage, and a current shunt configured to shunt at least a portion of the feedback current away from the first transistor so as to effect a reduction in the collector and the base currents of the first and third transistors thereby reducing low band noise contributions to said temperature insensitive voltage.

23. The circuit as claimed in claim 22 wherein the current shunt is configured to reduce the collector of the first and third transistors and as a result to effect a reduction in the base currents of the first and third transistors.

24. The circuit as claimed in claim 23 wherein the current shunt includes two npn transistors and on pnp transistor, the pnp transistor forming a fifth transistor of the circuit, the two npn forming sixth and seventh transistors of the circuit.

25. The circuit of claim 24 wherein the emitter areas of the transistors are chosen such that the second and third transistors have a first emitter area, n, the fourth transistor has a second emitter area n1, the first transistor has a third emitter area, n2, the fifth transistor has a fourth emitter area, n3, the sixth transistor has a fifth emitter area, n4 and the seventh transistor has a sixth emitter area, n5, the emitter areas being scaled such that n5>n4>n3>n2>n1>n.

26. The circuit of claim 22 wherein a capacitor has a value less than 1000 pF.

27. The circuit of claim 22 wherein the capacitor has a value less than 200 pF.

28. The circuit of claim 27 wherein the capacitor has a value of about 100 pF.

29. The circuit of claim 22 further including a curvature correction component.

30. The circuit of claim 29 wherein the curvature correction component is configured to provide a correction voltage of the type TlogT of opposite sign to that of the first order voltage reference voltage output, the correction voltage being combined with the first order voltage reference to provide a curvature corrected voltage reference.

31. The circuit of claim 22 wherein a capacitor is provided on-chip.

32. A voltage reference circuit including:

an amplifier having first and second inputs and an output, first and second npn transistors being associated with the first and second inputs of the amplifier respectively, the base of the first npn transistor being coupled to the second input of the amplifier and the collector of the first npn transistor being coupled to the first input of the amplifier such that the amplifier keeps the base and collector of the first transistor at the same potential, the second npn transistor being provided in a diode configuration, and wherein the first and second npn transistors are adapted to operate at different current densities such that a difference in base emitter voltages between the first and second npn transistors may be generated across a resistive load coupled to the second npn transistor, the difference in base emitter voltages being a PTAT voltage, first and second pnp transistors, the first pnp transistor being provided in a feedback configuration between the output of the amplifier and the first input of the amplifier, the second pnp transistor being provided in a diode configuration with the base and collector being commonly coupled via the resistive load to the second npn transistor and also to the second input of the amplifier, the collector of the first input of the amplifier, the arrangement of the first pnp transistor and first npn transistor providing a pre-amplification of the signal prior to the amplification provided by the amplifier, and a current shunt configured to shunt at least portion of the feedback current away from the first pnp transistor so as to effect a reduction in the collector and base currents of the first pnp transistor and of the first npn transistor.

* * * * *